US006609882B2

(12) United States Patent
Urlichs

(10) Patent No.: US 6,609,882 B2
(45) Date of Patent: Aug. 26, 2003

(54) DEVICE FOR COMPENSATING FOR AN AXIAL THRUST IN A TURBO ENGINE

(75) Inventor: Karl Urlichs, Nürnberg (DE)

(73) Assignee: Alstom Power Turbinen GmbH, Nuremberg (DE)

( * ) Notice: Subject to any disclaimer, the term of this patent is extended or adjusted under 35 U.S.C. 154(b) by 0 days.

(21) Appl. No.: 10/134,147

(22) Filed: Apr. 29, 2002

(65) Prior Publication Data

US 2002/0197150 A1 Dec. 26, 2002

Related U.S. Application Data

(63) Continuation of application No. PCT/EP00/10619, filed on Oct. 27, 2000.

(30) Foreign Application Priority Data

Oct. 27, 1999 (DE) ..... 199 51 570

(51) Int. Cl.[7] ..... F01D 3/00
(52) U.S. Cl. ..... 415/104; 415/111; 415/230
(58) Field of Search ..... 415/104, 106, 415/111, 112, 230, 231; 417/365

(56) References Cited

U.S. PATENT DOCUMENTS 1,151,965 A * 8/1915 Peterson ..... 415/106
2,005,429 A * 6/1935 Lichtenstein ..... 415/168.2
4,615,657 A * 10/1986 Kreitmeier ..... 415/104
5,104,284 A * 4/1992 Hustak et al. ..... 415/105

FOREIGN PATENT DOCUMENTS

| | | |
|---|---|---|
| DE | 289941 | 1/1916 |
| DE | 541079 | 1/1932 |
| DE | 4422594 A1 | 1/1996 |

OTHER PUBLICATIONS

Published International Application No. 99/30007 (Patel), dated Jun. 17, 1999.

* cited by examiner

*Primary Examiner*—Ninh H. Nguyen
(74) *Attorney, Agent, or Firm*—Laurence A. Greenberg; Werner H. Stemer; Ralph E. Locher

(57) ABSTRACT

A device for compensating an axial thrust in a turbomachine is described. A compensating piston is disposed in a compensation chamber and contains at least one radial seal operant between a rotor and a housing of the turbomachine in addition to a running wheel secured to the rotor. An axial seal is provided between a side surface pertaining to the compensating piston and the housing. An axial gap width is variable in the same manner as the axial displacement of the running wheel occurring during operation and the compensating piston is impinged upon by the pressure prevailing in the compensating chamber according to the axial gap width.

8 Claims, 2 Drawing Sheets

DEVICE FOR COMPENSATING FOR AN AXIAL THRUST IN A TURBO ENGINE

CROSS-REFERENCE TO RELATED APPLICATION

This application is a continuation of copending International Application No. PCT/EP00/10619, filed Oct. 27, 2000, which designated the United States and was not published in English.

BACKGROUND OF THE INVENTION

Field of the Invention

The invention relates to a device for compensating for an axial thrust in a turbo engine. The device has a radial seal that acts between a rotor and a housing of the turbo engine. An axial seal is provided and acts between the rotor and the housing. The turbo engine has a balance piston that is fixed to the rotor. The balance piston, the housing, the radial seal and the axial seal define a compensating chamber. An axial clearance of the axial seal is variable in correspondence to the operation-related axial displacement of the rotor. A compensating line is provided and brings about a pressure balance between a low-pressure region of the turbo engine and the device for compensating the axial thrust.

In a generally known device of this type, the axial forces that arise in the turbo engine are compensated with the aid of a balance piston. Such axial forces arise in both turbines and compressors. In order to improve the balance of forces, a number of balance pistons are provided in a step configuration. The behavior of individual stages of the steam turbine is taken into consideration by providing several ring surfaces, which are charged with the corresponding pressures prevailing in the stages. To accomplish this, compensating lines are needed by the stage groups, and furthermore the behavior of the stages must be simulated by appropriate seals. While thrust compensation is possible with this expensive configuration, a conventional anti-thrust bearing is still required on principle.

German Utility Model DE 17 01 436 teaches a device for compensating axial forces which is constructed as an auxiliary device and which is provided in addition to an anti-thrust bearing. In normal operation, the thrust bearing accepts the axial forces. Only upon overloading of the thrust bearing, i.e. given large axial movements of the turbine rotor, is the device activated for partial compensation of the axial forces.

German Patent DE 541 079 C teaches a steam turbine in which a partial compensation of an axial force is achieved by a balance piston. Here, a space that is defined by the balance piston, an axial seal and a radial seal is connected to a lower stage or to a capacitor. In order to prevent damage to the seals, above all in the idle state of the turbine and given unsteady operating conditions, a device for pushing the rotor of the steam turbine away from the seals by the external forces is required.

Published, Non-Prosecuted German Patent Application DE 44 22 594 A1, corresponding to U.S. Pat. No. 5,577,885, teaches a condensing turbine with at least two slip ring seals for sealing the turbine housing. A gap between the slip ring seal and the counter-ring that rotates with the rotor is independent of the thermal expansion of the condensing turbine. Linear deformations that occur are compensated in that the counter-ring is pressed against the slip ring under spring force. Therefore, the axial forces cannot be automatically corrected by the seal configuration known from DE 44 22 594. This is accomplished via a compensating line from the evaporation side of the condensing turbine to the space defined by the two slip ring seals and the balance piston.

Moreover, the condensing turbine requires at least one anti-thrust bearing for accepting the uncompensated axial thrusts.

International Patent Disclosure WO 99/30007 teaches a turbine with a balance piston in which a brush seal is provided at the balance piston.

SUMMARY OF THE INVENTION

It is accordingly an object of the invention to provide a device for compensating for an axial thrust in a turbo engine which overcomes the above-mentioned disadvantages of the prior art devices of this general type, which allows an optimally complete axial thrust compensation given a simple construction and without appreciably sacrificing the performance of the turbo engine.

With the foregoing and other objects in view there is provided, in accordance with the invention, in a turbo engine having a housing, a rotor disposed in the housing, a balance piston with a side surface fixed to the rotor, and a low pressure region in the housing, a device for compensating for an axial thrust. The device contains a radial seal acting between the rotor and the housing, and an axial seal disposed between the side surface of the balance piston and the housing. The balance piston, the housing, the radial seal and the axial seal define a compensating chamber. A space between the axial seal and the balance piston define an axial clearance and the axial clearance is variable in correspondence to an operation-related axial displacement of the rotor. A compensating line is provided for bringing about a pressure balance between the low-pressure region of the turbo engine and the device for compensating for the axial thrust. The balance piston is charged with a pressure prevailing in the balance chamber and the pressure being dependent on the axial clearance. The compensating line charges an additional space disposed between the compensating chamber and an environment and is defined by the housing and the rotor. The additional space has a final pressure.

Accordingly, the axial seal is provided between the side surface of the balance piston and the housing, whose axial clearance is variable in correspondence to the operation-related axial displacement of the runner. The axial piston is charged with the pressure prevailing in the compensation chamber, which depends on the axial clearance. The inventive device requires only an annular space defined by the axial seal, the radial seal, the housing the balance piston, an additional space defined by the rotor and the housing, and the compensating line. An anti-thrust bearing is not required. Despite this simple construction, a complete compensation of axial forces takes place in all operating conditions of the turbo engine.

Even a slight axial displacement of the runner leads to a change of the clearance in the axial direction due to the balance piston, which is likewise connected to the rotor. The resulting influence on the sealing action of the axial seal also changes the pressure acting on the piston face. The inventive seal configuration leads to an automatic pressure control on this face, whereby the axial position of the runner is automatically adjusted, and the axial forces of the runners are completely balanced with the axial force of the balance piston. For this self-regulating thrust compensation, it is necessary to use an axial seal with a first-rate sealing effect, because otherwise the axial movements of the rotor are too large.

The respective diameter of the axial seal and the radial seal is selected as a function of the functional diameter of the turbo engine. Given the correct selection of these parameters, approximately the initial pressure of the turbo engine ensues in the compensation chamber given an extremely small axial gap of the axial seal, whereas the final pressure of the turbo engine is effective in the compensation chamber given a very large gap, owing to a compensating line. This way, even the extreme values of the possible thrust forces are covered.

So that all possible thrust forces can be compensated, the sealing actions of the axial seal and the radial seal are matched to one another.

The axial seal is preferably constructed as a slip ring seal or a brush seal. Given the utilization of the slip ring seal or the brush seal, a ring seal configuration emerges, which gives rise to only slight displacements of the turbine rotor.

Coordinated with the axial seal is an additional axial seal, which is furnished with a large base clearance.

The additional axial seal serves as a backup seal. Owing to its large base clearance, it comes into play only if the main seal fails.

In order to secure unsteady operating conditions, an anti-thrust bearing can be allocated to the rotor, which, due to its clearance, only comes into play given the extreme opening of the seal chamber, and which does not transmit any axial forces or cause any friction losses in normal operation.

Other features which are considered as characteristic for the invention are set forth in the appended claims.

Although the invention is illustrated and described herein as embodied in a device for compensating for an axial thrust in a turbo engine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
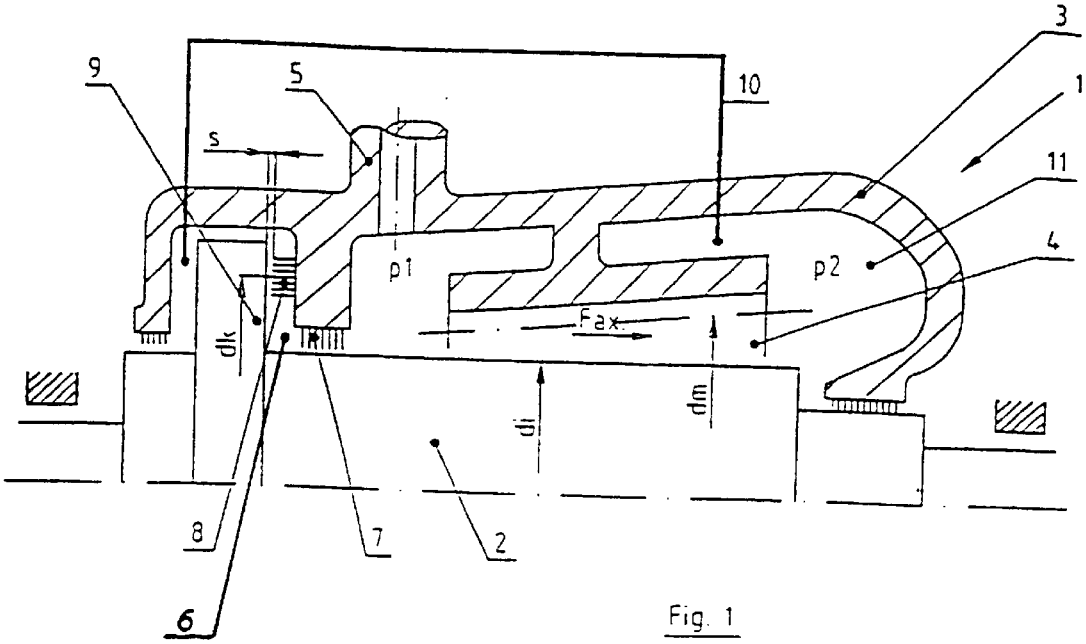
FIG. 1 is a diagrammatic, longitudinal sectional view through a sub-region of a turbo engine with a seal configuration according to the invention.

Referring now to the figures of the drawing in detail and first, particularly, to FIG. 1 thereof, there is shown a sub-region of a turbo engine 1 with a rotor 2 and a housing 3. Between the housing 3 and the rotor 2, several non-illustrated stators and runners are disposed in a region referenced 4. The stators, which are connected to the housing 3, and the runners, which are connected to the rotor 2, are passed by a medium which is supplied via a connector 5 and which has an initial pressure $p_1$. Upon passing through the runners, the medium has a final pressure $p_2$.

Also connected to the rotor 2 is a disk that rotates in a compensation chamber and which forms a balance piston 9 in connection with a radial seal 7 and an axial seal 8. A pressure behind the balance piston 9 is guaranteed by a compensating line 10 that leads into a space 11 that is charged with the final pressure $p_2$. The axial seal 8, which is exemplarily constructed as a brush seal, is disposed on at a defined diameter $d_k$ and fixed to the housing 3. It leaves a clearance S, referred to as an axial clearance S, to a side surface of the balance piston 9, whereby, given translatory motion of the runners and the rotor 2 in the direction of arrow $F_{ax}$, the clearance S is reduced by the measure of the translatory motion because the balance piston 9 co-executes the translatory motion. Because the axial seal 8 is constructed very "rigid", its tightness varies substantially even given small changes of the clearance S. Given a reduced clearance S, the pressure in the compensating chamber 6 approximately obtains the level of the initial pressure $p_1$. Given a large clearance S, a pressure approximating the final pressure $p_2$ sets in in the compensating chamber 6 owing to the compensating line 10. The functional diameters of the turbo engine $d_i$ and $d_m$ (inner and middle diameters of the blading) are so matched with the configuration diameter $d_k$ of the axial seal 8 and a non-illustrated configuration diameter $d_2$ of the radial seal 7, that all limits of the application are covered. The displacement force of the running path is continuously compensated by an absolutely self-regulating process, so that the balance of forces is maintained even given fluctuating axial thrusts.

Figure 2:
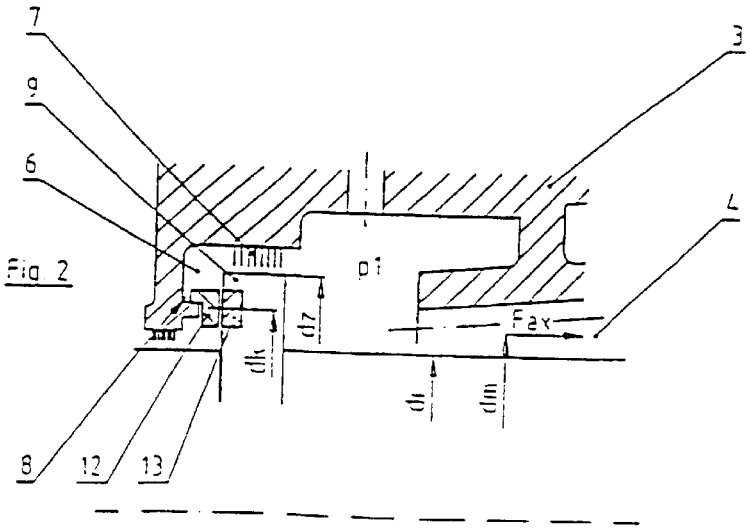
FIG. 2 is a longitudinal section view of a sub-region with another seal configuration.

FIG. 2 represents a subsection of the housing 3 with the connector 5 for the medium that is supplied under the initial pressure $p_1$. The runner in the area 4 with the middle diameter $d_m$ of its blading is passed by the medium, which leads to an axial shift in the direction of arrow $F_{ax}$. The balance piston 9 protrudes into the compensating chamber 6, whereby the radial seal 7 is provided between its outer diameter $d_2$ and the housing 3. In this exemplifying embodiment, the axial seal 8 is constructed as an axially acting slip ring seal, which is formed of undivided seals that slide upon each other with the aid of fluid. A slip ring 12 is allocated to the housing 3, and a counter-ring 13 is allocated to the balance piston 9, whereby a clearance S is formed. Given the correct matching of the axial seal 8 and the radial seal 7 with respect to their sealing action, the regulating process described in connection with FIG. 1 can be achieved here also.

Figure 3:
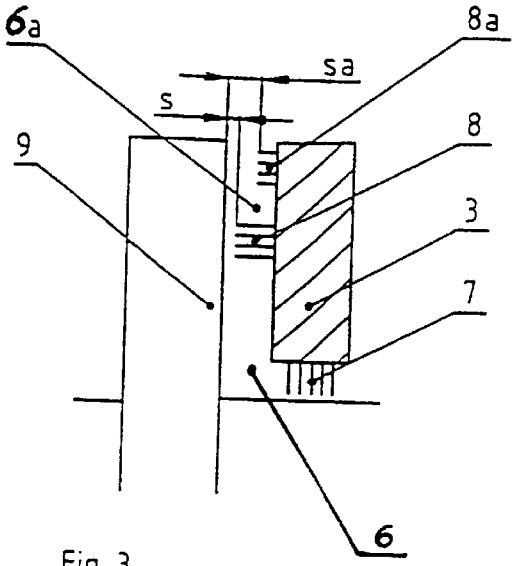
FIG. 3 is a sectional view with two radially disposed axial seals.

The section represented in FIG. 3 represents the axial seal 8 with the clearance S, which is disposed radially on the inside between the balance piston 9 and the housing 3. In order to improve the operational reliability, an additional axial seal 8*a*, whose clearance $S_a$ is larger than that of the axial seal 8, is disposed radially on the outside as a backup seal. The axial seal 8*a* will come into play only if the axial seal 8 fails. In order to monitor the function of the main seal 8, the pressure in the chamber 6 is measured and compared to the final pressure $p_2$.

Figure 4:
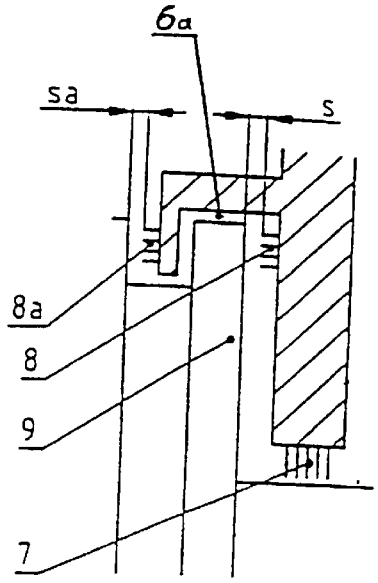
FIG. 4 is a sectional view with two axially disposed axial seals.

According to the representation in FIG. 4, the axial seals 8 and 8*a* are disposed next to one another in the axial direction, whereby the axial seal 8*a* with its larger clearance $S_a$ comes into play only if the axial seal 8 fails. In order to monitor the function of the main seal 8, the pressure in a chamber 6*a* is measured and compared to the final pressure $p_2$.

Figure 5:
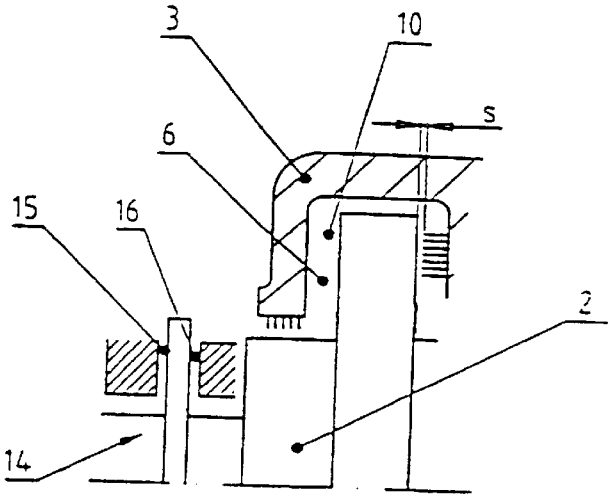
FIG. 5 is a sectional view showing an anti-thrust bearing.

A section of the representation according to FIG. 1 is represented in FIG. 5. Expanding on FIG. 1, in FIG. 5 an anti-thrust bearing 14 is provided to secure unsteady operating conditions. By virtue of intervals 15 and 16, the anti-thrust bearing 14, including an injection lubrication, is laid out in such a way that it only comes into play under boundary conditions. This prevents the losses of this bearing that are otherwise customary.

I claim:

1. In a turbo engine having a housing, a rotor disposed in the housing, a balance piston with a side surface fixed to the rotor, and a low pressure region in the housing, a device for compensating for an axial thrust, the device comprising:

a radial seal acting between the rotor and the housing;

an axial seal disposed between the side surface of the balance piston and the housing, the balance piston, the housing, said radial seal and said axial seal defining a compensating chamber, a space between said axial seal and the balance piston defining an axial clearance and said axial clearance being variable in correspondence to an operation-related axial displacement of the rotor; and a compensating line for bringing about a pressure balance between the low-pressure region of the turbo engine and the device for compensating for the axial thrust, the balance piston being charged with a pressure prevailing in said balance chamber and the pressure being dependent on the axial clearance, said compensating line charges an additional space disposed between said compensating chamber and an environment and defined by the housing and the rotor, the additional space having a final pressure.

2. The device according to claim 1, wherein said axial seal has a first diameter and said radial seal has a second diameter, said first diameter and said second diameter are selected in dependence on functional diameters of the turbo engine.

3. The device according to claim 1, wherein sealing actions of said axial seal and said radial seal are matched.

4. The device according to claim 1, wherein said axial seal is a slip ring seal.

5. The device according to claim 1, wherein said axial seal is a brush seal.

6. The device according to claim 1, wherein said axial seal is an adaptive seal with a small clearance.

7. The device according to claim 1, further comprising an additional axial seal fixed to the housing, a space between said additional axial seal and the balance piston defining a further clearance being larger than said axial clearance.

8. The device according to claim 1, further comprising an anti-thrust bearing allocated to the rotor for securing unsteady operating conditions.

* * * * *